United States Patent [19]

Bachman et al.

[11] 4,021,246

[45] May 3, 1977

[54] FREE RADICAL PHOTOSENSITIVE COMPOSITIONS CONTAINING BIS-SULFIDES OR SULFINYL ESTERS AS ANTIFOGGANTS

[75] Inventors: Paul L. Bachman, Cleveland Heights, Ohio; John S. Adams, Jr., deceased late of Chesterland, Ohio, by Dora E. Adams, administratrix

[73] Assignee: Horizons Incorporated, a division of Horizons Research Incorporated, Cleveland, Ohio

[22] Filed: Dec. 15, 1975

[21] Appl. No.: 641,031

[52] U.S. Cl. ..... 96/67; 96/90 R; 96/50 PL

[51] Int. Cl.[2] ..... G03C 1/52

[58] Field of Search ..... 96/90 R, 90 PC, 67, 96/50 PL

[56] References Cited

UNITED STATES PATENTS

| | | | |
|---|---|---|---|
| 3,042,515 | 7/1962 | Wainer | 96/90 R |
| 3,042,516 | 7/1962 | Wainer | 96/90 R |
| 3,102,810 | 9/1963 | Sprague et al. | 96/90 R |
| 3,442,649 | 5/1969 | Rasch et al. | 96/50 PL |
| 3,697,272 | 10/1972 | Ramins | 96/90 R |

*Primary Examiner*—Won H. Louie, Jr.
*Attorney, Agent, or Firm*—Lawrence I. Field

[57] ABSTRACT

This invention provides photosensitive compositions based on leuco dye and dye bases and which exhibit improved sensitivity and improved resistance to dark fogging as a consequence of the incorporation of organic bis-sulfide or sulfinyl ester compounds into photosensitive compositions comprising at least one leuco dye and at least one styryl, cyanine or merocyanine dye base. Preferably an additional improvement comprises provision of an overcoat for the photosensitive composition of this invention when in the form of thin films on a support such as a polyester or a paper sheet or glass plate. The overcoat acts to improve the shelf life and photosensitometric properties of the photosensitive composition.

9 Claims, No Drawings

FREE RADICAL PHOTOSENSITIVE COMPOSITIONS CONTAINING BIS-SULFIDES OR SULFINYL ESTERS AS ANTIFOGGANTS

This invention relates to non-silver, photosensitive compositions which print out an image directly upon exposure to suitable dosages of visible and/or actinic light, and to methods of improving the stability of such compositions. More specifically, it relates to improvements to non-silver, photosensitive, free radical compositions of the types described in the following U.S. Pat. Nos.

| | | |
|---|---|---|
| Wainer | 3,042,515 | issued July 3, 1962 |
| Sprague | 3,102,810 | issued September 3, 1963 |
| Sprague | 3,121,633 | issued February 18, 1964 |
| Sprague | 3,281,242 | issued October 25, 1966 |
| Sprague | 3,285,744 | issued November 15, 1966 |
| Sprague | 3,342,604 | issued September 19, 1967 |
| Wainer | 3,486,898 | issued December 30, 1969 |

and others of a similar nature.

Briefly, the photosensitive compositions of this invention comprise:

1. An image former consisting of at least one leuco dye former of the types described in the above noted patents and at least one dye base taken from the group consisting of styryl, cyanine and merocyanine dye bases; and 2. An organic halogen compound which provides free radicals when exposed to suitable radiation;

3. An organic bis-sulfide or sulfinyl ester which improves resistance to dark fogging.

The following are preferred additional (optional) constituents of the composition:

4. A film forming polymer or other binder in which the above constituents are dissolved or dispersed; and 5. A heterocyclic N-oxide.

Preferably, the photosensitive composition is in the form of a self-supporting film or in the form of a coating on a suitable support as described in the above noted patents.

It is well known that free radical photosensitive compositions based on leuco dye formers are capable of great sensitivity but that the leuco compounds are also sensitive to heat and air. Consequently, such free radical compositions exhibit poor stability, that is, poor shelf life or storage keeping properties such as described by Smith in U.S. Pat. No. 3,640,718 issued Feb. 8, 1972.

One known technique which has been used to mitigate this instability has been to lower the concentrations of active ingredients in the compositions in order to lower the rates of adverse chemical reactions associated with such instability. Another known technique employed to accomplish the same result has been to add various compounds such as phenols to the compositions in order to counteract one or more of the inherent instabilities. Both techniques, however, usually result in lower sensitivities, so that there has existed a reciprocal relationship between the photosensitivity which could be achieved and the shelf life stability for any composition. In other words, as the photosensitivity was increased by adjusting the proportions or constituents in a composition, the shelf life of the resulting composition was found to decrease. As a consequence such leuco-based photosensitive compositions which have any potential for practical utility have exhibited printout speeds in the range of ASA $10^{-6}$ to $10^{-7}$.

It has been found that the photographic sensitivity of such compositions can be increased between 10-fold and 100 fold with comparable or improved stability by the addition of certain sulfur-containing organic compounds to the photosensitive composition. The full benefits of this improvement are obtained by applying a hydrophilic overcoat to the photosensitive layer, e.g., as described in an earlier field U.S. patent application Ser. No. 364,092 filed May 25, 1973.

With the specific non-silver free radical compositions to which this invention applies two of the principal obstacles to realizing practical shelf life stability are loss of sensitivity and dark fogging.

Loss of sensitivity apparently results from a variety of causes, many of which are probably still unrecognized. Certain factors are recognized as important, however and they include:

1. loss of volatile activator from the composition as occurs with such preferred activators as carbon tetrabromide and iodoform; and 2. the effect of exposure to atmospheric contaminants especially oxidizing agents and acid constituents including oxygen, oxides of nitrogen, and sulfur and chlorine to mention only a few of the constituents which may be present in the environment in which the composition is being stored.

It has been found (as described in the above noted pending application) that overcoating the photosensitive layer with a hydrophilic polymer which possesses low permeability to small gas molecules both contains the volatile activator and excludes contaminating gases as well as particulate matter. For reasons of permeability, polyvinyl alcohol and poly(vinylpyrolidone) are the preferred hydrophilic film forming polymers for the overcoat but other hydrophilic polymers are also applicable for retaining the volatile activator in the photosensitive compositions described.

With the application of the hydrophilic overcoat, it was unexpectedly found that the photosensitivity of a given composition was enhanced along with other valuable photosensitive parameters such as gamma and Dmax. However, a tendency to dark fog remained which offered a serious obstacle to practical shelf life stability. Thus, although the photosensitivity of the compositions of interest is enhanced and is maintained in comparison to that exhibited by otherwise similar compositions without the overcoat, the base and fog (B and F) or background density of the compositions was found to increase upon storage in the dark. This tendency can be mitigated by storing at temperatures below ambient, even down to −70° C, but for many applications, such refrigerated storage is not practical, particularly not after use has begun.

It appears that inherent chemical instabilities result in slow formation of dye without exposure to light, a process commonly referred to as thermal fogging. It further appears that in the absence of an overcoat, the loss of sensitivity due to the loss of activator overshadows dark fogging. It also appears that the loss of activator also decreases the rate of dark fogging so that the film has usually lost all practical photosensitivity before dark fogging becomes apparent. In fact, it has been observed that film which are not provided with an overcoat will lose the greater portion of their initial sensitivity and if allowed to continue aging, will eventually show the formation of dark fog.

This invention resides in the addition of certain sulfur-containing organic compounds to the photosensitive composition in order to inhibit the formation of dark fog preferably, in combination with the hydrophilic overcoat in order to maintain high photosensitivity.

The organic sulfur compounds which have been found suitable for achieving this result are bis-sulfides and sulfinyl ester represented by the following general formulae.

The bis-sulfides which have been found to improve the sensitivity and to lessen dark fogging of photosensitive compositions based on the above are represented by the generalized formula:

$$CH_3(CH_2)_xS(CH_2)_nS(CH_2)_{x'}CH_3$$

wherein $n$ is an integer from 1 to 10 and each $x$ and $x'$ is an integer from 0 to 21.

The sulfinyl esters which have been found suitable in the compositions of the present invention are represented by the formula:

$$R_1OC(=O)-(CH_2)_p-S(=O)-(CH_2)_m-C(=O)-OR_2$$

in which $p$ and $m$ are each integers from 2 to 9 and $R_1$ and $R_2$ are each alkyl or alkenyl groups with up to 20 carbon atoms.

The bis-sulfides are named as sulfur-substituted alkanes, some typical examples with $x$ and $x'$ being the same are:

| n | x,x' | Name |
|---|---|---|
| 2 | 9 | 11,14-dithiatetracosane |
| 2 | 17 | 19,22-dithiatetracontane |
| 3 | 11 | 13,17-dithianonocosane |
| 4 | 9 | 11,16-dithiahexacosane |
| 4 | 11 | 13,18-dithiatriacontane |
| 4 | 0 | 2,7-dithiaoctane |
| 6 | 0 | 2,9-dithiadecane |
| 4 | 1 | 3,8-dithiadecane |
| 10 | 21 | 23,24-dithiahexapentacontane |

Sulfinyl esters which have been found suitable include the following in which $p$, $m$, $R_1$ and $R_2$ in the above formula are:

| p,m | R | Name |
|---|---|---|
| 2 | $CH_3(CH_2)_{10}CH_2$— | dilauryl β,β'-sulfinyl diproprionate |
| 2 | $CH_3(CH_2)_{14}CH_2$— | dipalmityl β,β'-sulfinyl diproprionate |
| 2 | $CH_3(CH_2)_{16}CH_2$— | distearyl β,β'-sulfinyl diproprionate |
| 2 | $CH_3(CH_2)_7CH{=}CH(CH_2)_7CH_2$— | di(9-octadecenyl) β,β'-sulfinyl diproprionate |
| 2 | $CH_3(CH_2)_3CH_2$— | di-n-butyl β,β'-sulfinyl diproprionate |
| 2 | $CH_3(CH_2)_6CH_2$— | di-n-octyl β,β'-sulfinyl diproprionate |
| 3 | $CH_3(CH_2)_{10}CH_2$— | dilauryl γ,γ'-sulfinyl dibutyrate |
| 3 | $CH_3(CH_2)_{16}CH_2$— | distearyl γ,γ'sulfinyl dibutyrate |
| 4 | $CH_3(CH_2)_{10}CH_2$— | dilauryl ω,ω'-sulfinyl valerate |
| 5 | $CH_3(CH_2)_{10}CH_2$— | dilauryl ω,ω'-sulfinyl capioate |
| 7 | $CH_3(CH_2)_{10}CH_2$— | dilauryl ω,ω'-sulfinyl caprylate |
| 9 | $CH_3(CH_2)_{10}CH_2$— | dilauryl ω,ω'-sulfinyl capriate |

Effective concentrations range from 0.1 to 0.001 that of the combined weight of leuco compounds and dye bases present with the preferred concentration being one-sixtieth to one-twentieth.

Because of the greater ease of preparation and hence greater availability, symmetrical compounds in which $R_1$ and $R_2$ are the same in which $p$ and $m$ are equal are preferred, but it is not intended that the invention be restricted only to symmetrical compounds.

Proportions

The compositions of this invention have the following proportions of the several components:

| Constituent | Broad Range | Preferred |
|---|---|---|
| Leuco dye | 1 to .01 | .4 to .1 |
| Dye base | .5 to .01 | .2 to .05 |
| Organic halogen compound | 10 to .10 | 4 to 1 |
| Organic sulfur compound | 0.1 to 0.0001* | .04 to .004* |
| Binder | 1 | 1 |
| N-oxide (optional) | .3 to .005 | .15 to .02 |

The use of organic sulfur compounds to stabilize the photosensitive compositions against fogging should not be confused with the use of organic sulfur compounds in non-silver free radical photosensitive compositions such as those described in the following U.S. Pat. Nos. and others of similar nature:

| | |
|---|---|
| 3,042,516 | issued July 3, 1962 |
| 3,285,744 | issued November 15, 1966 |
| 3,342,595 | issued September 19, 1967 |
| 3,342,602 | issued September 19, 1967 |
| 3,342,603 | issued September 19, 1967 |
| 3,342,604 | issued September 19, 1967 |
| 3,351,467 | issued November 7, 1967 |
| 3,510,309 | issued May 5, 1970 |
| 3,533,792 | issued October 13, 1970 |
| 3,573,911 | issued April 6, 1971 |

These patents disclose the use of heterocyclic organic sulfur compounds for entirely different purposes.

In U.S. Pat. Nos. 3,285,744; 3,342,595; 3,342,602; 3,342,603; 3,342,604 and 3,481,739 the use of heterocyclic mercaptans, heterocyclic disulfides, heterocyclic sulfur compounds, thioureas and thioacetanilides as activators are described.

In U.S. Pat. No. 3,351,467 the use of leuco xanthenes as the color forming compound and thiazoles as activators is described.

In U.S. Pat. No. 3,573,911 the use as arylthioketones as color forming compounds is described.

In U.S. Pat. No. 3,533,792 the use of thiols, pyrazolones and thioacetanalides to form a colored reaction product is described.

None of the above describes the use of the present sulfur compounds as stabilizers against fog formation.

The invention will be better understood from the Examples which follow which are intended to be illustrative of preferred embodiments and are not intended to limit the invention.

EXAMPLE I

A photosensitive composition was prepared by dissolving 2,7-bis(dimethylamino)-10-p-dimethylaminophenyl-9,10-dihydro-9,9-dimethylanthracene (100 mg), 4-picoline-N-oxide (20 mg), 2-(p-dimethylaminostyryl)-quinoline (64 mg) and carbon tetrabromide (1.2 g) in 4.5 ml of a 10% by weight solution of Styron 686 polystyrene in benzene in total darkness. The solution was coated 0.0015 inches wet thickness on a polyethylene terephthalate base using a vacuum channel plate and drawbar applicator. The film was allowed to air-dry several minutes, then removed from the coating plate and cut into two strips one of which was placed on a box and stored at ambient temperature.

The other strip was exposed though a standard Kodak Type 1A steptablet to a uniform light source corrected to a color temperature of 5700° K. The strip was given a 58,000 meter-candle-second (MCS) printout exposure and then fixed by rinsing for several minutes in a solution of petroleum ether/acetone/Stoddard solvent (8:2:1 by volume). The resulting seven step magenta image, as read with a Wratten 93 green filter, had a Dmax of 1.86 and a base plus fog (B+F) of 0.07.

The second strip was identically processed after 5 hours storage. A three step magenta image with Dmax 0.80 and B+F 0.07 was obtained.

EXAMPLE II

A photosensitive film was prepared according to Example I and a polyvinylalcohol overcoat was then applied. After the photosensitive layer had air-dried several minutes, a 10% aqueous solution of Elvanol 52-22 polyvinylalcohol was applied with a drawbar at a wet thickness of 0.006 inches and allowed to air-dry for 15 minutes before cutting the film into two pieces. The overcoat was removed from the first strip by evenly applying a piece of masking tape and carefully lifting. This strip was then given a 58,000 MCS direct printout exposure and processed as in Example I. The result was a seven-step magenta image with a Dmax of 1.82 and a B+F of 0.07. The second strip was processed identically after 5 hours storage at ambient temperature. A seven-step magenta image with a Dmax of 1.90 and a B+F of 0.15 was produced.

EXAMPLE III

A photosensitive film with polyvinylalcohol overcoat was prepared according to Example II. A freshly prepared strip was given a 35,000 MCS exposure through the overcoat. The overcoat was removed and the film fixed according to Example I giving an eight-step magenta image with a Dmax of 1.85 and a B+F of 0.06. A second strip was identically processed after five hours storage at ambient temperature yielding an eight-step magenta image with a Dmax of 1.99 and a B+F of 0.18.

EXAMPLE IV

A photosensitive composition was prepared by dissolving 4,4′,4″-methylidynetris-(N,N-dimethylaniline) (70 mg), 4-picoline-N-oxide (10mg), 2-(p-dimethylamino styryl)-quinoline (65 mg) and carbon tetrabromide (1.2 g) in 5.0 ml of a 10% by weight solution of MX 4500 (Dow) polystyrene in benzene. This solution was used to prepare a film according to Example I. A freshly prepared strip was given a direct printout exposure of 58,000 MCS to produce an eight-step purple image with a Dmax of 2.22 and a B+F of 0.07 as read with a Wratten 94 blue filter. A second strip was identically processed after storing in the dark at ambient temperature for 3 hours. The result was a five-step magenta image with a Dmax of 1.08 and a B+F of 0.06 as read with a Wratten 93 green filter.

EXAMPLE V

The photosensitive films of Example IV was overcoated, exposed and processed according the the procedure described in Example III. A direct printout exposure of 35,000 l MCS produced a seven-step purple image with a Dmax of 1.85 and a B+F of 0.08 (Wratten 94 blue filter). A second strip was identically processed after 5 hours storage at ambient temperature and produced a seven-step purple image with a Dmax of 1.75 and a B+F of 0.09. Still a third strip after storing 22 hours produced a similar seven-step purple image with a Dmax of 1.13 and a B+F of 0.11.

EXAMPLE VI

A photosensitive composition similar to that in Example I was prepared except that the 100 mg of 2,7-bis(dimethylamino)-10-p-dimethylaminophenyl-9,10-dihydro-9,9-dimethylanthracene was replaced with 100 mg of 2,7-bis(dimethylamino)-9,10-dihydro-9,9-dimethylanthracene. The film was overcoated and processed as described in Example III. A 38,000 MCS exposure of a freshly prepared strip gave a nine-step blue image with a Dmax of 1.61 and a B+F of 0.07 (Wratten 93 green filter). A second overcoated strip, aged seven hours at ambient temperature gave an eight-step image with a Dmax of 1.71 and a B+F of 0.18.

EXAMPLE VII

The photosensitive film of Example II was overcoated with 4½% aqueous solution of poly(vinylpyrolidone) in place of polyvinylalcohol. A 58,000 MCS printout exposure produced a seven-step magenta image with a Dmax of 1.95 and a B+F of 0.06. A second strip, aged 5 hours, gave a seven-step image with a Dmax of 1.92 and a B+F of 0.10.

EXAMPLE VIII

The photosensitive composition and film of Example II was prepared but with the addition of a sulfinyl ester. Printout exposures of 58,000 MCS were made after removal of the overcoat for fresh films and films which were aged 3 and 24 hours at ambient temperature. The effects of the added stabilizer are seen in the following table.

Table 1

| Additive | Amount (mg) | Base Plus Fog at x-hours | | |
|---|---|---|---|---|
| | | 0 | 3 | 24 |
| (Control) | — | 0.09 | 0.13 | 0.25 |
| Distearyl β,β′-sulfinyl diproprionate | 5.0 | 0.13 | 0.13 | 0.13 |
| Distearyl β,β′-sulfinyl diproprionate | 2.5 | 0.07 | 0.08 | 0.10 |
| Dilauryl β,β′-sulfinyl diproprionate | 10.0 | 0.11 | 0.09 | 0.12 |

EXAMPLE IX

The photosensitive composition and film of Example I was prepared but with the addition of a bis-sulfide rather than a sulfinyl ester. The films were aged and processed in an identical manner to produce the following results.

Table 2

| Bis-Sulfide x | n | Amount (mg) | Base Plus Fog at x-hours 0 | 3 | 24 |
|---|---|---|---|---|---|
| Control | | — | .09 | .13 | .25 |
| 9 | 2 | 3.7 | .09 | .10 | .08 |
| 9 | 4 | 4.0 | .09 | .09 | .08 |
| 11 | 4 | 4.6 | .08 | .10 | .10 |
| 17 | 2 | 5.9 | .12 | .11 | .11 |

We claim:

1. In a photosensitive composition consisting essentially of:

1. at least one leuco diaryl or triaryl methane dye forming compound;
2. at least one dye base selected from the group consisting of styryl dye bases, cyanine dye bases and merocyanine dye bases;
3. at least one organic halogen compound which provides free radicals when exposed to a suitable does of radiation; and a film forming polymer in which constitutes (1), (2) and (3) are supported;

the improvement which comprises including in said composition an organic sulfur compound selected from the group consisting of bis-sulfides represented by the formula $$CH_3(CH_2)_xS(CH_2)_nS(CH_2)_{x'}CH_3$$

wherein $n$ is an integer from 1 to 10 and each of $x$ and $x'$ is an integer from 0 to 20 and sulfinyl esters represented by the formula $$R_1OC-(CH_2)_p-\overset{O}{\overset{\uparrow}{S}}-(CH_2)_m-COR_2$$

in which $p$ and $m$ are each integers from 2 to9 and $R_1$ and $R_2$ are each selected from the group consisting of alkyl and alkenyl groups with up to 20 carbon atoms, said organic sulfur compound being present in said composition in an amount which is effective to provide improved resistance to dark fogging.

2. The composition of claim 1 wherein the amount of sulfur compound is between one-tenth and one ten-thousandth the combined weight of leuco dye and dye base.

3. The composition of claim 2 wherein the amount of sulfur compound is between one-sixtieth and one-twentieth the combined weight of leuco dye and dye base.

4. The composition of claim 1 wherein $R_1$ and $R_2$ are the same.

5. The composition of claim 1 wherein $R_1$ and $R_2$ are t-butyl.

6. The composition of claim 1 wherein the leuco compound is leuco crystal violet.

7. The composition of claim 1 wherein the dye base is 2,7-bis-(dimethylamino)-10-p-dimethylaminophenyl-9,10-dihydro-9,9-dimethylanthracene.

8. The composition of claim 1 wherein the dye base is 2,7-bis-(dimethylamino)-9,10-dihydro-9,9-dimethylanthracene.

9. A film according to claim 1 wherein the photosensitive composition is in layer form and is overcoated uniformly with a layer of polyvinylalcohol or polyvinylpyrolidone.

* * * * *